US006830053B2

(12) United States Patent
Tanaka et al.

(10) Patent No.: US 6,830,053 B2
(45) Date of Patent: Dec. 14, 2004

(54) CIGARETTE WRAPPER PAPER WITH SUPPRESSED SCATTERING OF ASH

(75) Inventors: Yasuo Tanaka, Yokohama (JP); Atsushi Nagao, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/179,963

(22) Filed: Jun. 26, 2002

(65) Prior Publication Data

US 2002/0189626 A1 Dec. 19, 2002

Related U.S. Application Data

(63) Continuation of application No. PCT/JP00/09197, filed on Dec. 25, 2000.

(30) Foreign Application Priority Data

Dec. 27, 1999 (JP) ..... 11-371800

(51) Int. Cl.[7] ..... A24D 1/02
(52) U.S. Cl. ..... 131/365; 162/139
(58) Field of Search ..... 131/349, 365; 162/139

(56) References Cited

U.S. PATENT DOCUMENTS 4,548,677 A * 10/1985 Schneider et al. ..... 162/139
5,109,876 A 5/1992 Hayden et al.

FOREIGN PATENT DOCUMENTS

| | | |
|---|---|---|
| EP | 0 139 934 A1 | 5/1985 |
| EP | 0 842 615 A1 | 5/1998 |
| JP | 10-81 A | 1/1998 |

* cited by examiner

*Primary Examiner*—Dionne A. Walls
(74) *Attorney, Agent, or Firm*—Birch, Stewart, Kolasch & Birch, LLP

(57) ABSTRACT

A cigarette wrapper paper formed of a pulp containing at least 60% by weight of fibrous components, particularly, a flax pulp. The cigarette wrapper paper permits markedly suppressing the scattering of the cigarette ash without increasing the addition amount of a loading material promoting combustion or the addition amount of a combustion assistant.

10 Claims, No Drawings

CIGARETTE WRAPPER PAPER WITH SUPPRESSED SCATTERING OF ASH

CROSS-REFERENCE TO RELATED APPLICATIONS

This is a Continuation Application of PCT Application No. PCT/JP00/09197, filed Dec. 25, 2000, which was not published under PCT Article 21(2) in English.

This application is based upon and claims the benefit of priority from the prior Japanese Patent Application No. 11-371800, filed Dec. 27, 1999, the entire contents of which are incorporated herein by reference.

BACKGROUND OF THE INVENTION

1. Field of the Invention

The present invention relates to a cigarette wrapper paper, and more particularly, to a cigarette wrapper paper that permits suppressing the scattering of the ash formed by the combustion of the cigarette wrapper paper.

2. Description of the Related Art

A cigarette is provided by wrapping a tobacco filler material, such as cut tobacco, by a cigarette wrapper paper. The cigarette wrapper paper is formed of pulps of, for example, wood or flax, and contains a loading material such as calcium carbonate to increase the opaqueness and whiteness of the cigarette wrapper paper and to increase the combustion capability of the cigarette wrapper paper, and a combustion assistant to control the combustion capability of the cigarette wrapper paper. The cigarette wrapper paper thus prepared regulates the combustion characteristics of the cigarette. In addition, the cigarette wrapper paper controls the properties of the ash, particularly the scattering properties of the ash, of the cigarette formed by the combustion.

The ash of the cigarette, if separated easily from the cigarette so as to be scattered, contaminates the surroundings. Some improvements of the cigarette wrapper paper have been proposed for suppressing the scattering of the ash of the cigarette. For example, it is proposed in Jpn. Pat. KOKAI Publication No. 11-36193 that calcium carbonate particles having a specified particle size are added to the cigarette wrapper paper. Also, it is disclosed in U.S. Pat. No. 5,161,551 that calcium carbonate particles having a specified particle size are added in an increased amount to a cigarette wrapper paper.

However, calcium carbonate, though required for the combustion of the cigarette wrapper paper, has a detrimental effect on the taste and flavor of the cigarette if the addition amount thereof is excessively large. In addition, the combustion rate of the cigarette wrapper paper is promoted and the mechanical strength of the cigarette wrapper paper is lowered so as to bring about an inconvenience in the making of the cigarette if calcium carbonate is added in an excessively large amount.

Therefore, an object of the present invention is to provide a cigarette wrapper paper that permits suppressing the scattering of the ash of the cigarette without increasing the amount of loading material promoting the combustion such as calcium carbonate and the amount of the combustion assistant.

BRIEF SUMMARY OF THE INVENTION

As a result of extensive research conducted in an attempt to overcome the above-noted problems, the present inventors have found that, if the cigarette wrapper paper is formed of a flax pulp and if the bast fiber content of the flax pulp is increased, it is possible to suppress significantly the scattering of the ash of the cigarette without increasing the amount of loading material having combustion promoting property, such as calcium carbonate, and without increasing the amount of the combustion assistant. The present invention is based on these findings.

Accordingly, the present invention provides a cigarette wrapper paper capable of suppressing the scattering of the ash, the cigarette wrapper paper being formed of a pulp containing at least 60% by weight of fibrous component.

In the present invention, it is preferred that the pulp be formed of a flax pulp and the fibrous component is bast fiber of the flax pulp.

A cigarette wrapper paper according to the present invention may have a basis weight of 20 to 70 g/m$^2$.

Further, a cigarette wrapper paper according to the present invention may further contain a loading material which exhibits combustion promotion, or a combustion assistant.

DETAILED DESCRIPTION OF THE INVENTION

The present invention will now be described in more detail below.

The present inventors have looked into the scattering mechanism of the ash formed by the combustion of cigarette wrapper paper. It has been found that cigarette wrapper paper is shrunk by the combustion heat, and the shrinkage acts on the contact resistance point between the ash of the cigarette wrapper paper and the ash of the cut tobacco leaves so as to bring about cracking in the ash, with the result that fine broken pieces drop down as ash. It follows that the scattering of the ash of the cigarette wrapper paper can be suppressed by decreasing the shrinkage of the cigarette wrapper paper caused by the combustion heat and by decreasing the number of cracks generated in the ash formed by the combustion of the cigarette wrapper paper.

The pulp forming the cigarette wrapper paper of the present invention is not particularly limited, and the pulp generally used for preparing cigarette wrapper paper, including, for example, a flax pulp, a wood pulp such as N-BKP or L-BKP, a herbaceous bast fiber pulp such as hemp, jute or kenaf, a leaf fiber pulp such as Manila hemp or sisal hemp, a true grass pulp such as straw or esparto, and a seed fluff fiber pulp such as cotton or linters, can be used. A flax pulp is particularly preferred.

The pulp forming the cigarette wrapper paper of the present invention contains at least 60% by weight of fibrous components and the balance of a ligneous component. The fibrous component in the wood pulp corresponds to the wood portion and the fibrous component in the non-wood pulp corresponds to the bast fiber. The flax pulp used preferably in the present invention is manufactured through the processes of reaping, removal of seeds and small branches, refining, drying, pulverization of the stalk, beating, and cutting into linear state. Particularly, it is possible to control the ratio of the bast fiber component by the pulverizing process of the stalk.

In the present invention, it is possible to suppress markedly the scattering of the cigarette ash (particularly the ash generated from the cigarette wrapper paper itself), without increasing the amount of the loading material for promoting the combustion such as calcium carbonate and the amount of the combustion assistant, by setting the fibrous component of the pulp constituting the cigarette wrapper paper at 60% by weight or more, particularly, by setting the bast fiber component in the flax pulp at 60% by weight or more. For example, where the addition amount of calcium carbonate is set constant, it is possible to decrease the scattering rate of the cigarette ash by about 30% or more by simply increasing the bast fiber component of the flax pulp from 45% by weight to 80% by weight. Where the rate of decrease of this level is to be achieved, it is necessary to increase the amount of the loading material for promoting combustion to a level two times or more (e.g., in the case of calcium carbonate, to increase the amount from the ordinary level of 4.5 g/m$^2$ to 9 g/m$^2$, or to increase the addition amount of the combustion assistant (e.g., a citrate salt) to a level 10 times or more (e.g., to increase from the ordinary level of not higher than 1% to 10%). It is desirable for the amount of the fibrous component in the pulp, particularly, the amount of the bast fiber component in the flax pulp, to be at least 70% by weight, more desirably at least 75% by weight, and most desirably at least 80% by weight.

The cigarette wrapper paper of the present invention may be added with coated with a loading material promoting combustion such as calcium carbonate and a combustion assistant. Any combustion assistant used in ordinary cigarette wrapper paper such as an alkali metal salt may be used. Sodium citrate, potassium citrate or a mixture thereof is particularly preferred. As calcium powder, use may be made of a calcium carbonate powder having an average particle diameter of about 0.2 to 0.5 $\mu$m. Calcium carbonate is added typically in an amount of 10 to 35% by weight, though the effect of suppressing the ash scattering can be promoted with increase in the mixing amount of calcium carbonate. On the other hand, the combustion assistant, when added, is added to the cigarette wrapper paper typically in an amount of 0.7 to 1.3% by weight, though the effect of suppressing the ash scattering can be promoted with increase in the mixing amount of the combustion assistant. At any rate, the scattering of the cigarette ash can be significantly suppressed by setting the amount of the fibrous component in the pulp at 60% by weight or more according to the present invention, making it possible to decrease the mixing amounts of the loading material promoting the combustion and the combustion assistant in accordance with the desired degree of decrease in the scattering amount of the cigarette ash or to increase the mixing amounts of the loading material promoting the combustion and the combustion assistant for further decreasing the scattering amount of the cigarette ash.

Usually, the cigarette wrapper paper of the present invention has a basis weight of 20 g/m$^2$ to 70 g/m$^2$.

In the present invention, the shrinkage of the cigarette wrapper paper in the combustion stage can be measured in accordance with the method disclosed in the thesis "BURNING PROCESS OF CELLULOSIC FIBERS COMPOSING FILTER PAPER DURING FLAME SPREAD" by Shotaro Suzuki et al. in the academic magazine "Fire Science and Technology, pp 499–504 (1992)". Specifically, the cylindrical cigarette wrapper paper obtained by taking out the cut tobacco leaves from a cigarette is disposed vertically, and fire is set to the upper edge of the cylindrical cigarette wrapper paper so as to burn the cylindrical cigarette wrapper paper under static burn conditions. Under these conditions, the progression speed of the combustion line (the char line or the leading edge in which the paper is turned black) and the moving speed of the point moving in accordance with the shrinkage of the cigarette wrapper paper (the moving speed of a point in the formed ash region) are measured under observation at a magnification of about 100, followed by dividing the former value by the latter value, so as to obtain the shrinkage of the cigarette wrapper paper in the combustion stage. It should be noted that the progression speed of the combustion line corresponds to the progression amount of combustion per unit time, and the moving speed of the point moving in accordance with the shrinkage corresponds to the moving amount accompanying the shrinkage of the cigarette wrapper paper per unit time. It follows that, since the progression speed of the combustion line and the moving speed of the moving point are common to each other in the lapse of time, it is possible to obtain the shrinkage moving amount per unit amount in the progress of combustion, i.e., the combustion shrinkage of the cigarette wrapper paper, by diving the former by the latter.

Also, in the present invention, the number of cracks in the ash is measured as follows. Specifically, a cigarette is disposed vertically such that the tip of the cigarette (fire catching edge) constitutes the uppermost edge, and fire is set to the tip of the cigarette so as to burn the cigarette under static burn conditions. Under this state, the number of cracks generated in the ash formed in the central portion, which has a width of 5 mm, of the cigarette in the longitudinal direction ranging between a point 10 mm away from the tip of the cigarette and a point 40 mm away from the tip of the cigarette (i.e., the central portion having a length of 30 mm and a width of 5 mm) is visually counted by observation under magnification of about 35. In counting the number of cracks, the size of the crack is not taken into account. However, the crack formed to extend over two stages or cracks extending from a single original crack are counted as two cracks.

Further, in the present invention, the scattering rate of the cigarette ash can be measured as follows. Specifically, a cigarette sample is mounted on a vibrating module, and the vibrating module is driven by a control unit such that the vibrating module is vibrated by continuous driving at a frequency of 160 Hz and an acceleration of 14 G so as to simulate the situation that a cigarette held by the smoker's hand is being moved, while the cigarette sample is subjected to the static burn from the tip to a point 10 mm away from the tip. The amount of the scattered ash is measured so as to calculate as the scattering rate the scattered amount of the ash relative to the total weight of the ash that is formed when the cigarette sample is subjected to the combustion to a point 10 mm away from the tip. The ash scattering rate is measured similarly for 5 cigarette samples having the same specification. The reduction rate of the scattering of the cigarette ash is obtained by the formula "$[(A-B)/A]\times 100$ (%)", where "A" denotes the ash scattering rate of a reference cigarette, e.g., an ordinary cigarette, and "B" denotes the ash scattering rate of the target cigarette. Incidentally, the ash formed when the cigarette is subjected to the combustion to a point 10 mm away from the tip of the cigarette is the ash of mainly the cigarette wrapper paper.

Examples of the present invention will now be described. However, the present invention should not be limited by these Examples.

EXAMPLE 1

A cigarette wrapper paper was manufactured by using the flax pulp having the specification shown in Table 1. Cigarettes each having a filter attached thereto were wrapped by the cigarette wrapper paper. Each cigarette had a circumference of 25 mm and an entire length of 84 mm. Also, 0.70 g of cut tobacco leaves was loaded in each cigarette. In order to measure the combustion shrinkage of the cigarette wrapper paper by the method described above, the cut tobacco leaves were taken out of the cigarette. Each cigarette was used as it was in order to count the number of cracks generated in the ash formed by the combustion of the cigarette by the method described above. Table 1 also shows the results.

TABLE 1

| Sample No. | Specification of flax pulp cigarette wrapper paper: Bast fiber component (% by weight) | Basis weight ($g/m^2$) | Amount of calcium carbonate* (% by weight) | Amount of sodium citrate (% by weight) | Results of measurement: Combustion Shrinkage | Number of cracks |
|---|---|---|---|---|---|---|
| 1 | 61.7 | 23 | 31.6 | 1.1 | 20.9 | 93.6 |
| 2 | | | | 2.1 | 19.7 | 107.2 |
| 3 | | | | 4.7 | 16.2 | 59.0 |
| 4 | 81.2 | 23 | 33.8 | 1.2 | 18.8 | 79.7 |
| 5 | | | | 2.0 | 17.9 | 79.6 |
| 6 | | | | 4.8 | 13.2 | 50.6 |
| 7 | 81.9 | 23 | 41.5 | 1.0 | 15.2 | 63.6 |
| 8 | | | | 2.2 | 13.2 | 68.4 |
| 9 | | | | 4.9 | 10.8 | 57.1 |

*Trade name: PCX-580 available form Shiroishi Kogyou K.K.

Table 1 clearly shows that the combustion shrinkage of the cigarette wrapper paper and the number of cracks can be decreased by increasing the bast fiber content of the flax pulp. This clearly indicates that the scattering of the cigarette ash can be suppressed by increasing the bast fiber content of the flax pulp.

EXAMPLE 2

A cigarette wrapper paper was manufactured by using flax pulp having the specification shown in Table 2. Cigarettes each having a filter attached thereto were wrapped by the cigarette wrapper paper. Each cigarette had a circumference of 25 mm and an entire length of 84 mm. Also, 0.70 g of cut tobacco leaves was loaded in each cigarette. Incidentally, the cigarette for the Comparative Example corresponds to the ordinary cigarette.

The cigarette ash scattering rate, etc., were measured by, for example, the method of measuring the scattering of the cigarette ash described above in respect of each of the cigarettes prepared. Table 2 also shows the results.

TABLE 2

| Sample | Specification of flax pulp cigarette wrapper paper: Bast fiber component (% by weight) | Basis Weight ($g/m^2$) | Amount of $CaCO_3$* (% by weight) | Ash scattering characteristics: Total ash amount during 10 mm combustion (mg) | Ash scattering amount (mg) | Scattering Rate |
|---|---|---|---|---|---|---|
| Example 2 | 80 | 63 | 10 | 1.70 | 0.92 | 54% |
| Comp. Ex. | 45 | 62 | 10 | 1.67 | 1.31 | 78% |

*Trade name: Multiflex available from Specialty Minerals Inc., U.S.A.

As apparent from Table 2, the cigarette wrapper paper of the present invention permits markedly decreasing the ash scattering rate. The rate of reduction in the ash scattering achieved by the cigarette wrapper paper of the present invention is calculated to be about 30% relative to the cigarette wrapper paper for the Comparative Example.

As described above, the cigarette wrapper paper of the present invention permits markedly lowering the scattering of the cigarette ash without increasing the addition amount of the loading material for promoting the combustion or the addition amount of the combustion assistant.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cigarette wrapper paper capable of suppressing cigarette ash scattering, said cigarette wrapper paper being formed of a pulp containing at least 70% by weight of bast fiber components.

2. The cigarette wrapper paper according to claim 1, wherein said pulp is a flax pulp, and said bast fiber components are those of the flax pulp.

3. The cigarette wrapper paper according to claim 1, wherein said cigarette wrapper paper has a basis weight falling within a range of 20 to 70 $g/m^2$.

4. The cigarette wrapper paper according to claim 2, wherein said cigarette wrapper paper has a basis weight falling within a range of 20 to 70 $g/m^2$.

5. The cigarette wrapper paper according to claim 2, further comprising a loading material for promoting combustion or a combustion assistant.

6. The cigarette wrapper paper according to claim 1, wherein said pulp contains at least 80% by weight of bast fiber component.

7. The cigarette wrapper paper according to claim 2, wherein said pulp contains at least 80% by weight of bast fiber component.

8. The cigarette wrapper paper according to claim 2, wherein said pulp contains at least 75% by weight of bast fiber component.

9. A cigarette wrapper paper capable of suppressing cigarette ash scattering, said cigarette wrapper paper being formed of a flax pulp containing at least 80% by weight of bast fibers, and having a basis weight of 20 to 70 $g/m^2$.

10. The cigarette wrapper paper according to claim 9, further comprising a loading material for promoting combustion or a combustion assistant.

* * * * *